US005447754A

United States Patent [19]

Jasper

[11] Patent Number: 5,447,754

[45] Date of Patent: Sep. 5, 1995

[54] ALUMINIZED STEEL ALLOYS CONTAINING CHROMIUM AND METHOD FOR PRODUCING SAME

[75] Inventor: Joseph C. Jasper, Middletown, Ohio

[73] Assignee: Armco Inc., Middletown, Ohio

[21] Appl. No.: 230,042

[22] Filed: Apr. 19, 1994

[51] Int. Cl.[6] ..... B05D 3/00

[52] U.S. Cl. ..... 427/320; 427/329; 427/432; 427/434.2; 427/436

[58] Field of Search ..... 427/320, 329, 432, 434.2, 427/436

[56] References Cited

U.S. PATENT DOCUMENTS

| | | | |
|---|---|---|---|
| 2,197,622 | 4/1940 | Sendzimir | 91/70.2 |
| 3,925,579 | 12/1975 | Flinchum et al. | 427/320 |
| 4,675,214 | 6/1987 | Kilbane et al. | 427/320 |
| 5,023,113 | 6/1991 | Boston et al. | 427/320 |
| 5,175,026 | 12/1992 | Bertol et al. | 427/307 |

FOREIGN PATENT DOCUMENTS

| | | | |
|---|---|---|---|
| 2071189 | 8/1993 | Canada | C23C 2/12 |
| 0467749 | 7/1991 | European Pat. Off. | C23C 2/12 |

*Primary Examiner*—Benjamin Utech

*Attorney, Agent, or Firm*—Larry A. Fillnow; Robert J. Bunyard; Robert H. Johnson

[57] ABSTRACT

Steel alloys containing chromium may be hot dip aluminized in a bath having up to 15% silicon with improved wettability by using a bright preannealing practice in a box furnace having a substantially pure hydrogen atmosphere. The surfaces of the preannealed steel are easily coated if the box annealing furnace has a dew point of less than −60° C. (−75° F.). The preannealing should also include a minimum soak of at least 1 hour at a temperature of 675° C. to 785° C. (1250° F. to 1450° F.). It is important that the surfaces of the strip after preannealing are not removed prior to aluminizing. During the aluminizing operation, the strip temperature does not need to be heated to much above the bath temperature since the strip has already been preannealed. The furnace is maintained to avoid oxidation with an atmosphere which is typically a nitrogen, hydrogen or a hydrogen-nitrogen mixture. The surfaces of the steel prior to entering the aluminum bath have improved wettability and result in far less uncoated spots due to the improved surfaces provided by the preanneal in the dry box anneal. For ferritic stainless steels, such as Type 409, the surfaces have an iron enriched layer.

15 Claims, No Drawings

ALUMINIZED STEEL ALLOYS CONTAINING CHROMIUM AND METHOD FOR PRODUCING SAME

BACKGROUND OF THE INVENTION

The present invention relates generally to steel alloys containing chromium which are coated with aluminum which may contain up to 15% silicon. More particularly, the present invention relates to an aluminized ferritic stainless steel, such as AISI Type 409. Continuous coating lines for hot dip aluminizing strip include in-line cleaning of surface oxides and annealing treatments. Many of these coating lines use a direct fired furnace at elevated temperatures with an atmosphere of gaseous products of combustion of fuel and air but no free oxygen. Strip is then normally heated in a radiant tube furnace and cooled to bath temperature. The strip enters the coating bath and the amount of coating metal is adjusted in a finishing operation.

Steel alloys containing chromium are known to be difficult to aluminize. This has generally been attributed to chromium oxides on the surfaces being very difficult to wet. Depending on the base metal composition, oxides of chromium, aluminum, titanium and silicon form during heat treatment and are not easily reduced. They remained on the surfaces of the steel alloy and inhibited the reaction between the substrate and the aluminum coating metal during the immersion of the strip in the bath. Uncoated portions and pinholes resulted.

Preparation of chromium alloy steel strip for hot dip aluminizing has included the cleaning of the strip and the maintaining of a protective hydrogen atmosphere prior to coating. Typically, the coating furnace was used to anneal the strip to develop the desired mechanical properties and bring the strip to a temperature above the bath temperature prior to coating. Various coating methods have been developed to improve the wettability of the chromium bearing alloys.

U.S. Pat. No. 4,891,274 teaches that silicon greater than 0.1% caused wettability problems and titanium greater than 0.16% acted as a reducing agent during steel melting and contributed to silicon being introduced to the melt from the slag and refractofies. Silicon levels below 0.1% were important for wettability to avoid the formation of silicon oxides on the strip during the coating process.

U.S. Pat. No. 4,675,214 taught that it was necessary to provide a reducing atmosphere once the strip exited the direct fired furnace to minimize chromium oxidation. Typically, the strip was heated from 677° C. to 954° C. in the radiant tube furnace having an atmosphere such as 20% by volume hydrogen with 80% by volume nitrogen and cooled to 660° C. to 732° C. in an atmosphere with almost pure hydrogen and a dew point preferably below −12° C. and oxygen below 40 ppm before entering the coating bath.

U.S. Pat. No. 5,023,113 believed that even no free oxygen in a direct fired furnace still had a significant oxidizing potential due to the presence of water and the chromium present on the surfaces. Chromium oxide formed on the surfaces of the strip was not removed by the protective hydrogen atmosphere prior to entry into the coating bath. The temperature in the direct fired furnace was lowered while still removing the oil, din and iron oxide on the surfaces and attempted to avoid excessive oxidation of the chromium. The strip was then further heated to a fully annealed condition in another furnace section having at least 95% hydrogen, less than 200 ppm oxygen and a dew point less than 0° F. (−18° C.). The strip was then passed through the snout of the furnace having a protective atmosphere with at least 97% hydrogen and a dew point no greater than −20° F. (−29° C.) before passing into the coating bath.

U.S. Pat. No. 4,883,723 heated a ferritic alloy to a temperature of at least 1232° F. (666° C.) or the temperature of the molten aluminum bath. The atmosphere was at least 95% hydrogen and the dew point was no more than 40° F. (5° C.). The heating was typically done in a direct rued furnace and a radiant tube furnace which were connected to the coating bath.

Other approaches to improve the wettability of ferrous alloys containing chromium provided an intermediate coating prior to aluminizing. These coating layers were nickel or copper based or developed an iron-boron or iron-phosphorus layer prior to aluminizing. U.S. Pat. No. 4,891,274 provided a nickel coating to improve the wettability of chromium alloy steels. The patent taught that a satisfactory aluminum coating can not be obtained using conventional coating practices if the oxygen in the atmosphere is greater than 1 ppm and the dew point is higher than −40° C. Control of these levels in the furnace was taught to be difficult and that the surfaces will suffer from oxidation with resulting poor wettability and coating defects.

Recently, there have been two other approaches to improve the wettability of chromium alloys for aluminum. The first one was EP 467,749 which taught a method which avoided the need for high purity hydrogen in the aluminizing furnace. By preheating the strip at less than 500° C. (932° F.) in a nonoxidizing atmosphere containing less than 3% oxygen and heating the strip in a second nonoxidizing atmosphere to a temperature less than 950° C. (1740° F.) in an atmosphere having a dew point of less than −40° C. (−40° F.) and preferably less than −50° C. (−58° F.), the atmosphere in the cooling furnace and snout did not need to be pure hydrogen. The strip surfaces could be passed through a nonreactive atmosphere such as nitrogen or a nitrogen/hydrogen atmosphere. The nitrogen atmosphere had less than 20 ppm oxygen and a dew point of less than −60° C. (−76° F.) and the hydrogen atmosphere had less than 10 ppm oxygen and a dew point of less than −60° C. (−76° F.). The strip temperature was cooled to about bath temperature and passed into the bath. An aluminum bath with silicon was stated to minimize the alloy layer and reduce brittleness. The method for preparing strip to be aluminized in a continuous coating furnace had a total treatment time of less than about 7 minutes.

Canadian patent application 2,071,189 coated chromium containing steel strip by using a method which included preannealing the strip, alkaline cleaning the strip, rinsing and drying the strip and radiantly heating the strip in a hydrogen-nitrogen (25–50% by volume hydrogen—balance nitrogen) atmosphere with substantially no oxygen and water vapor at a temperature below 1470° F. (800° C.) and typically 1350° F. to 1400° F. (733° C. to 760° C.) to limit the growth of chromium oxides. A controlled dew point of −30° F. (−35° C.) to −10° F. (−23° C.) at the entry side; −50° F. (−45° C.) to −45° F. (−43° C.) downstream; and −60° F. (−51° C.) in the snout was used to provide a reducing atmosphere for the chromium oxides. The strip was coated in an aluminum bath containing about 10% silicon. Preannealing the strip before it was subjected to the inventive method provided the same properties as annealing done on the coating line. There were no preannealing conditions given.

Prior coating methods for aluminizing chromium alloys without the use of additional coating layers have thus relied upon a coating furnace which cleaned the strip and annealed the strip in-line using hydrogen/nitrogen atmospheres with controlled levels of oxygen and dew points to avoid the oxidation of the chromium on the surfaces.

Bright annealing stainless steel in a protective atmosphere using a continuous annealing line or a box anneal has been done to prevent discoloration and provide a clean, bright surface condition. Pure hydrogen or a mixture of hydrogen and nitrogen are used to keep the surfaces in a bright condition. The material is used extensively for automotive trim, kitchenware and other applications which require a bright, shiny surface. The use of a hydrogen atmosphere is expensive and substituting nitrogen reduces the cost. Nitrogen, however must be controlled since it could lead to nitrogen pickup (nitriding) and hydrogen has the potential to cause hydrogen embrittlement. Box annealing practices have also been limited in the past in the control of dew point in the furnace required for producing a bright surface.

Another important consideration for any annealing practice is the condition of the steel surfaces after annealing. Most continuous annealing treatments include a pickling step to remove the scale on the surfaces. During heating, the steel may react with the oxidants such as oxygen, water and carbon dioxide to form oxides that make up scale. The annealing time, temperature and atmosphere will determine the nature of the scale. Chromium, aluminum, silicon and titanium on the surfaces are very easily oxidized.

The preparation of steel alloys containing chromium for hot dip aluminizing has been difficult in the past due to the poor wettability of the surfaces and the nature of chromium oxides. The present invention is directed to the production of preannealed chromium alloy steel surfaces for aluminizing and aluminized chromium alloy steel with greatly reduced uncoated spots.

SUMMARY OF THE INVENTION

The present invention is directed to providing an improved preannealed chromium alloy steel strip to be aluminized by a hot dip process wherein the bath may be substantially pure aluminum, an aluminum bath containing silicon up to 15% or an aluminum bath containing other alloying elements. The aluminized chromium alloy steel strip is improved by the reduction of uncoated spots on the surfaces provided by dry box annealing in a bright annealing atmosphere and by preserving the surfaces formed during preannealing until the strip is aluminized. Any pickling or cleaning of the surfaces which destroys the preannealed surface is to be avoided. The preannealed surfaces are maintained while in the coating furnace by using any atmosphere which is nonoxidizing. The strip temperatures in the coating furnace may also be reduced or the line speed increased since the material has already been preannealed.

A chromium alloy steel, typically a ferritic stainless steel such as Type 409 having about 10% to about 14.5% chromium, is box annealed prior to coating using a bright annealing hydrogen atmosphere with a very low dew point of less than −60° C. (−75° F.). A box anneal in dry hydrogen provides surfaces on chromium alloy steels which are more easily wetted than surfaces prepared by other annealing techniques. The improved surfaces are provided using box annealing times and temperatures selected for mechanical properties in combination with a high purity hydrogen atmosphere having a very low dew point selected for producing surfaces for aluminum wettability. The preannealed surfaces are characterized by an iron enrichment which is believed to provide the improved wettability.

Preannealing chromium alloy steels allow the aluminizing furnace to be run at lower temperatures and higher line speeds since the furnace is not relied upon to develop the desired mechanical properties but to provide strip at a temperature of at least the bath temperature. The strip surfaces of the preannealed steel do not require a high purity hydrogen atmosphere in the coating furnace to develop wettable surfaces if the preannealed surfaces are maintained. The coating line furnace requirements are thus simplified to maintain the existing strip surface conditions and provide strip at a temperature of at least the bath temperature.

An object of the present invention is to provide chromium bearing alloy steel strip which has more wettable surfaces when hot dipped in an aluminum coating process.

An additional object of the present invention is the production of surfaces on a chromium alloy strip which have a higher iron to chromium ratio than previously provided by other annealing methods.

A feature of the present invention is the use of a box annealing furnace for annealing chromium alloys using a dry bright annealing atmosphere to develop strip surfaces which are more wettable by aluminum in a continuous hot dip coating operation.

An additional feature of the present invention is the use of a hydrogen box annealing atmosphere which has a dew point less than −60° C. (−75° F.) for improving the wettability of the strip surfaces.

A still additional feature of the present invention is the preserving of the iron enriched surfaces developed during the box anneal to enable the surfaces to be wettable when contacting the aluminum bath.

It is an advantage of the present invention that the aluminized strip will have greatly improved quality due to the reduction of uncoated spots.

It is an additional advantage of the present invention that the preannealed strip will permit higher line speeds to be used in the coating furnace since the strip does not need to be heated to annealing temperatures.

It is a still further advantage of the present invention that the costs for the gases used in the coating furnace are reduced since high purity hydrogen gas is not required to provide wettable surfaces.

The above objects, features and advantages and others will become apparent upon consideration of the detailed description.

DESCRIPTION OF THE PREFERRED EMBODIMENTS

Hot dip aluminizing steel strip which contains chromium has always been a difficult task due to the presence of chromium oxides on the surfaces which are not easily wetted during immersion in the coating bath. Since hot dip coating lines have annealing and cleaning capacity built into the equipment, the preparation of the surfaces for coating has not generally included a precleaning or a preannealing step. These steps prior to coating are an additional expense which typically have not been justified. Since one has to heat the strip up to at least the temperature of the coating bath in the coating furnace, it has been the normal practice to include the annealing treatment as part of the cycle to prepare the strip for coating. A continuous annealing treatment done outside the coating furnace will typically include a final cleaning or pickling step to remove surface oxides and other surface conditions. It is only with the realization that a chromium alloy strip which has been bright annealed in a box furnace using very dry hydrogen produces surfaces which are drastically different from other surfaces being coated that one can justify the preannealing costs.

When the term "strip" is used in the present invention, it is to be understood that it refers to a continuous strand which does not have a width or thickness limitation and could include a strand which is circular in cross section. All composition ranges in the following description are made on weight % basis and all atmosphere limitations are made on a volume basis. The hot dip aluminizing is also meant to include the coating of only one side of the strip (one surface) where the strip is not immersed in the bath but contacts the surface.

Most aluminum coatings contain silicon at a level of about 10% and these are identified as Type 1. The silicon is primarily added to control the alloy layer between the iron and aluminum. Type 2 aluminum coatings are substantially pure aluminum except for normal impurities and iron caused by dissolution from the steel passing through the bath.

Very thin oxides on the steel strip surfaces may be reduced by the reactive aluminum bath. Chromium oxides on the surfaces are much more difficult to reduce than other oxides and must be kept very thin to permit wettability. Controlling the thickness of the chromium oxide in the annealing furnace is very difficult to accomplish since chromium is readily oxidized. Box annealing in a dry, bright annealing atmosphere produces surfaces on chromium steels which are wettable if preserved up to the time the steel enters the coating bath.

The preannealed surfaces of the present invention are attributed to the effect of box annealing using relatively pure hydrogen and low dew points below −60° C. (−75° F.), preferably less than −62° C. (−80° F.) and still more preferably less than −65° C. (−85° F.). Obtaining these very low dew points in a box annealing furnace requires a gas tight enclosed base design and tightly controlled operating conditions. The box annealing cycle also provides longer times at soak temperatures than a continuous anneal which may also contribute to the improved surface conditions.

During preannealing, the steel strip surfaces will have the lubricants removed by initially boiling off the water at 100° C. and then hydrogenating the lubricant hydrocarbons at typically around 400° C. The lubricant residues are less likely to dissociate if uniform heating is accomplished. The highly reducing hydrogen atmosphere converts any oxide residues from pickling, storage and cold rolling at a temperature around 600° C. to water vapor which reacts with the reduced amounts of carbon on the strip to form carbon monoxide.

The strip's alloying elements are not likely to oxidize with the highly reducing potential of the atmosphere (hydrogen gas and a low dew point). The clean metal surfaces are very important in the wettability of the surfaces for aluminizing. In addition, the surfaces are characterized by very little edge oxidation and very little chromium oxidation in the grain boundaries. The improved weltability of the strip surfaces is believed to be attributed to iron enrichment at the surface which was determined to be present using several methods and over a wide range of depths. While the exact theory to explain the surface condition has not been fully defined, it is known that the surfaces are clearly different from any other methods of surface preparation and it is known that the dry box annealing conditions described above produce the desired conditions sufficient to insure an aluminizing operation which is greatly simplified and which produces a level of quality not previously obtainable with other hot dip practices.

The improved surfaces on the chromium alloy strip to be aluminized are preserved by not pickling after the preannealing operation which would remove the outer surfaces and provide surfaces similar to the base metal. The improved preannealed surfaces has a significantly higher Fe to Cr ratio than the base metal when a high hydrogen and low dew point atmosphere is used during bright annealing in a furnace such as the Ebner HICON/$H_2$ ® bell furnace.

The broad range for chromium present with steels of the present invention may vary from as low as 0.5% up to 30% or more. Typically the steels will have at least 6% chromium and more typically at least 8% chromium. Chromium ranges of about 10% to about 30% are normally used.

The strip surfaces may also have alloying elements such as Ti and Al which are present in Type 409 stainless steel. Aluminum is typically present in a range of about 0.01% to 0.1% and titanium is present in an amount of at least 0.1% and may range as high as 0.5% or higher. Titanium may be present in alloys in an amount ranging up to about 1% or higher. The outside layers are enriched with these alloying elements when present in the base metal. The presence of elements such as Ti and Al which traditionally formed oxides that are hard to coat, do not present a problem when the annealing is conducted in a bright annealing box furnace with the present atmosphere and due point controls. If these elements form oxides which are not reduced during the reduction of the strip prior to entry into the coating bath, one would expect them to form dross (aluminum oxide) on the bath surface which attaches to the strip and separates during finishing, thus leaving uncoated spots.

Other purposeful additions and residual elements may be present in the ferritic, martensitic or austenitic ferrous alloys depending on the properties required as is well known in the art.

The strip surfaces are developed as a result of the preannealing conditions in a bright, box anneal cycle. In continuous strip annealing and conventional box annealing, which is not bright annealing, the surfaces are not prepared as they are in the present invention. Continuous annealing and conventional box annealing do not have the dew point control, substantially pure hydrogen atmosphere and longer soak times which provide strip surfaces with good wettability for an aluminum bath.

Bright annealing of the chromium steel alloys is done in a high convection bell furnace using a hydrogen rich atmosphere. In particular, HICON/$H_2$ ® furnaces by Ebner Furnaces, Inc. have been used successfully. The use of pure hydrogen process atmosphere with a very low dew point is critical in developing the clean surfaces required for aluminizing as well as the desired mechanical properties.

The Ebner system uses a gas tight base with an all metal cover enclosing the internal base insulation. High speed fans are used for convective heat transfer to increase the heating and cooling rates of the system. The process atmosphere is heated by the furnace which can be gas fired or electric. A high speed base fan circulates the pure hydrogen process atmosphere along the horizontally corrugated inner cover wall transferring heat in special convector plates which provide balanced atmosphere and hence very uniform heating and cooling of the material in process. Cooling is accomplished by a combination of forced air and water cooling to keep the cycles as short as possible.

The Ebner furnace has many features which improve the level of dryness as measured by the dew point. Some of these include the all metal encased workload space of the annealing furnace which prevents entry of oxygen or water vapor, thermal insulation which is sealed under a concave casing, a water cooled circular element for the work base and cover flange and a water cooled cover plus a circular rubber element over the fan motor provides excellent sealing. An impeller provides excellent circulation and rapid heating/cooling rates. Other features include an intake diffuser in the load plate, special convector plates and high flow rate process atmosphere circulation along the inner cover wall which may be heated by gas burners or electric heating elements. The charge is cooled down by means of a combined air/water cooling bell which provides for a short cooling cycle.

Prior to heating the coils in the box furnace, the furnace should be purged to remove as much oxygen as possible. Nitrogen gas may be used to bring the level of oxygen to an amount below 1,000 ppm and preferably as low as possible.

During the heat-up stage of the annealing cycle, the atmosphere normally includes hydrogen mixed with the nitrogen. It is important to control the surface conditions during heating and cooling since the strip oxidizes easily at the lower temperatures.

Another reason for low dew points during the annealing treatment is to remove the oils and lubricants on the surfaces of the steel strip. Typically, these oils crack or evaporate at about 700°–900° F. (370°–482° C.). The use of hydrogen atmospheres and high gas flow rates also serve to improve the removing of the oils. This is particularly true during the heat-up portion of the annealing cycle where the flow of atmosphere should be increased to remove the oils. The soak temperature provides a condition between the vaporization temperature and the cracking temperature for the oils. Control of these conditions result in bright clean surfaces which have improved wettability.

The box annealing of Type 409 stainless steel in dry hydrogen forms subsurfaces which are extremely enriched in titanium and aluminum. Type 409 typically has about 0.01–0.1% aluminum and 0.1 to 0.5% titanium. The aluminum concentration is typically about 10 times the level of the base metal at the subsurfaces. The titanium is also enriched significantly at the subsurfaces. These subsurfaces do not interfere with the wettability as might be expected by the nature of oxides of titanium and aluminum which are known to be difficult to wet. The subsurface enrichment is not deep and easily reduced by the aluminum bath. Other steel alloys containing chromium will develop this subsurface condition if titanium and/or aluminum is present in the base metal. The relative amount of enrichment will depend on the base metal composition. Iron enriched surfaces which may have uniform dispersions of alloying elements provides surfaces with improved wetting characteristics and forms the heart of the present invention. The surface layers are very thin. It is clear that these layers must be preserved which requires attention to numerous factors such as atmosphere interactions during subsequent processing and the need to not clean or pickle the surfaces prior to the steel entering the aluminizing furnace.

Most of the prior attempts to aluminum coat steel alloys containing chromium have attempted to minimize the formation of chrome oxides by using reducing atmospheres and low dew points in the coating furnace. Since most manufacturing operations use continuous annealing whenever possible, the differences between box annealing were not appreciated.

The improved wettability of the preannealed strip of the invention is attributed to the control of the oxidation of the alloying elements. Elements with a strong affinity for oxygen, such as chromium, aluminum, titanium and silicon have the oxidation controlled prior to coating by box annealing in an atmosphere that has a very low oxidizing potential. This is achieved by a low ratio of water vapor to hydrogen that is related to a very low dew point. The present invention thus places the alloying elements in a condition which is easily removed/reduced by the aluminum coating bath. Other elements such as chromium may be depleted near the surfaces which are enriched in iron to improve wettability.

Safety is always of utmost concern when annealing in hydrogen. Various safety control features may be used to monitor the atmospheres in the annealing furnace and provide any emergency shut downs or atmosphere changes as are well known in the art. It is important to note that the high hydrogen contents used in the anneal require some extra safety precautions to insure that there are no leaks.

A series of T409 coils were box annealed using a bright anneal practice in an Ebner HICON/$H_2$® furnace. The coils had a typical rolling emulsion on the surfaces prior to annealing. The coils were annealed in 100% purified hydrogen with an aim temperature of about 825° C. (1520° F.). Material for aluminizing was 0.89 mm (0.035 inch) thick and 1180 mm (46.375 inches) wide. The coils were in the box annealing furnace for 53 hours and were above 1400° F. for 14.5 hours. The time above 1400° F. could be easily reduced and still make mechanical properties and reduce the chance for any hydrogen embrittlement. A dew point below −60° C. (−75° F.) was used. Lower aim temperatures would still provide the desired mechanical properties and increase productivity in the furnaces.

The coils were then aluminized using the teachings of the high hydrogen atmospheres taught in U.S. Pat. Nos. 4,6175,214 and 5,023,113 and jet finished using conventional techniques to provide a uniform coating weight within standard operating ranges. The finishing conditions are not a limitation of the present invention and the preannealed material may have the aluminum coating thickness varied to any levels using any means well known in the art.

The coils had very little oxide pattern and excellent mechanical properties. The coils were then processed in the furnace of the aluminizing furnace with excellent results using existing coating practices. A dew point below −18° C. (0° F.) was maintained in the aluminizing furnace.

TABLE 1

| CHEMISTRY | | | | | | | | |
|---|---|---|---|---|---|---|---|---|
| % C | % Mn | % Cr | % Ni | % Ti | % N | % Si | % Al | % Fe |
| 0.006 | 0.24 | 10.97 | 0.12 | 0.185 | 0.009 | 0.45 | 0.035 | Balance |

TABLE 2

| MECHANICAL PROPERTIES | | | | | |
|---|---|---|---|---|---|
| UTS ksi | .2% YS ksi | T ELONG | HARD RB | r VALUE | OLSEN IN |
| 61.5 | 32.7 | 34.5 | 67 | 1.61 | 0.350 |

Tensile properties are in the longitudinal direction and tested before coating.

The preannealed strip was shown to provide the desired mechanical properties as well as the improved surfaces for weltability using the bright annealing atmosphere in the box annealing practice described above. All of the above coils of steel coated very well and were relatively free of any uncoated spots. The present invention has great utility in providing an annealed coil of steel material containing chromium which lends itself to the use of lower hydrogen levels and lower temperatures in the aluminizing furnace which improves productivity and lowers operating cost. The practice of the present invention also provides surfaces which are much more wettable with the hot dip aluminum coating methods which were previously very difficult to use without developing uncoated spots on the strip.

Alloys containing chromium will have proannealed surfaces developed by the box annealing practice of the present invention with unexpected properties when aluminum coated in a continuous hot dip process. This iron enrichment or chromium depletion are conditions which improve weltability. Typical continuous annealing followed by pickling provides a surface ratio of about 2:1 to 3:1. (iron:chromium) for Type 409 stainless steel. The improved surfaces for wetting with molten aluminum obtained by the present invention were significantly richer in iron and had a surface ratio of at least 5:1. The exact ratios will vary depending on the initial chromium content and the box annealing cycle conditions. While not wishing to be bound by theory, the present invention provides strip surfaces which are more easily wetted by an aluminum bath without the need for any other coating treatments to improve weltability. It is believed that the improved surfaces results from the very dry atmosphere obtained in a bright box annealing furnaces such as Ebner's HICON/$H_2$ ® bell furnace. The dew point must be maintained below −60° C. (−75° F.) to insure that the atmosphere is not oxidizing to the chromium in the steel.

It is important to note that the present invention which provides a bright preannealed strip allows the coating furnace atmosphere to have a reduced hydrogen atmosphere compared to the high purity hydrogen atmospheres used previously. This is due to the condition of the preannealed surfaces which do not require the highly reducing atmospheres of the past. While the example used a high purity hydrogen atmosphere in the coating line, there is no reason other nonoxidizing furnace atmosphere could not be used. Any combination of hydrogen and nitrogen is sufficient when using a bright preannealed material from a box annealing practice provided the iron enriched surfaces are maintained. Any coating practice may be used in combination with the bright box annealed material of the present invention and will benefit from the improved wettability as long as the surfaces from the preannealed material is not substantially altered prior to entering the coating bath.

Various modifications may be made to the present invention without departing from the spirit and scope of it. For example various modifications may be made to the atmospheres used in the aluminizing furnace which form no pan of the invention so long as the desired surface layer conditions are not impaired. Numerous modifications may be made to the base metal but the steels will still enjoy the improved wettability provided by the box annealing practice of the present invention. Numerous finishing methods may be used after the strip enters the coating bath and these do not form any limitations on the present invention. Therefore, the limits of the present invention should be determined from the appended claims.

I claim:

1. A method for continuous hot dip aluminizing in an aluminum bath a steel alloy strip containing chromium greater than 0.5%, said method comprising the steps of:

a) box annealing said strip in a substantially 100% hydrogen atmosphere having a dew point less than −60° C. at a temperature of 675° C. to 785° C., said annealing being sufficient to provide strip surfaces characterized by an iron to chromium ratio greater than 3:1;

b) maintaining said box annealed strip surfaces after said box anneal;

c) heating said strip to a temperature of at least the temperature of said aluminizing bath in an aluminizing furnace having a nonoxidizing atmosphere;

d) maintaining said box annealed strip surfaces in said aluminizing furnace in a nonoxidizing atmosphere until said strip enters said aluminum bath;

e) delivering said strip to said aluminizing bath at a temperature at or above the temperature of said aluminizing bath; and f) hot dip aluminizing said strip to provide an aluminum coated strip containing chromium.

2. The method of claim 1 wherein said aluminizing furnace atmosphere is selected from the group consisting of nitrogen, hydrogen and nitrogen-hydrogen with a dew point less than −18° C.

3. The method of claim 1 wherein said dew point in said box annealing atmosphere is less than −62° C.

4. The method of claim 1 wherein said dew point in said box annealing atmosphere is less than −65° C.

5. The method of claim 1 wherein said steel alloy contains at least 6% chromium.

6. The method of claim 1 wherein said steel alloy contains at least 8% chromium.

7. The method of claim 1 wherein said steel alloy contains 10% to 30% chromium.

8. The method of claim 1 wherein said steel alloy contains at least 0.1% titanium and 0.01 to 0.1% aluminum.

9. The method of claim 1 wherein said box anneal is conducted in a gas tight enclosed base.

10. The method of claim 1 wherein said box anneal is conducted in pure hydrogen.

11. The method of claim 1 wherein said box anneal is conducted in a high convection bell furnace.

12. The method of claim 1 wherein said box anneal is conducted in a bell furnace with an all metal cover enclosing internal base insulation.

13. The method of claim 1 wherein said iron to chromium ratio on said box annealed strip surfaces is at least 5:1.

14. The method of claim 1 wherein chromium is depleted on said box annealed strip surfaces.

15. The method of claim 1 wherein said box anneal is conducted in an Ebner HICON/$H_2$ ® furnace.

* * * * *